US007686128B2

(12) United States Patent
Ono

(10) Patent No.: US 7,686,128 B2
(45) Date of Patent: Mar. 30, 2010

(54) SPEAKER DIAPHRAGM AND SPEAKER

(75) Inventor: Yushi Ono, Neyagawa (JP)

(73) Assignee: Onkyo Corporation, Osaka (JP)

( * ) Notice: Subject to any disclaimer, the term of this patent is extended or adjusted under 35 U.S.C. 154(b) by 189 days.

(21) Appl. No.: 11/716,119

(22) Filed: Mar. 9, 2007

(65) Prior Publication Data

US 2007/0235251 A1 Oct. 11, 2007

(30) Foreign Application Priority Data

Mar. 24, 2006 (JP) ..... 2006-083180

(51) Int. Cl.

| | |
|---|---|
| ***G10K 13/00*** | (2006.01) |
| ***H04R 7/10*** | (2006.01) |
| ***H04R 7/06*** | (2006.01) |
| *H04R 7/02* | (2006.01) |

(52) U.S. Cl. ..... 181/169; 181/167; 381/426; 381/428

(58) Field of Classification Search ..... 181/169, 181/167, 170; 381/426, 428, 423
See application file for complete search history.

(56) References Cited

U.S. PATENT DOCUMENTS

| | | | | |
|---|---|---|---|---|
| 2004/0112672 | A1 | 6/2004 | Ono et al. | |
| 2005/0051380 | A1 | 3/2005 | Takayama et al. | |
| 2005/0232457 | A1 * | 10/2005 | Hachiya et al. | 381/426 |
| 2005/0232458 | A1 * | 10/2005 | Hachiya | 381/426 |
| 2006/0266577 | A1 * | 11/2006 | Inoue et al. | 181/167 |
| 2006/0266578 | A1 * | 11/2006 | Takayama et al. | 181/167 |

FOREIGN PATENT DOCUMENTS

| | | | |
|---|---|---|---|
| JP | 52002723 | A | 1/1977 |
| JP | 53095617 | A | 8/1978 |
| JP | 59-125194 | U | 8/1984 |
| JP | 62131696 | A | 6/1987 |
| JP | 2003-204593 | B2 | 7/2003 |
| JP | 2005080098 | A | 3/2005 |
| JP | 2005101889 | A | 4/2005 |

* cited by examiner

*Primary Examiner*—Edgardo San Martin
(74) *Attorney, Agent, or Firm*—The Webb Law Firm

(57) ABSTRACT

A speaker diaphragm includes a substrate and a surface material. The surface material is arranged on one side of the substrate, and includes a woven fabric of a polyethylene naphthalate fiber.

11 Claims, 2 Drawing Sheets

SPEAKER DIAPHRAGM AND SPEAKER

This application claims priority under 35 U.S.C. Section 119 to Japanese Patent Application No. 2006-83180 filed on Mar. 24, 2006, which is herein incorporated by reference.

BACKGROUND OF THE INVENTION

1. Field of the Invention

The present invention relates to a speaker diaphragm and a speaker. More specifically, the present invention relates to a speaker diaphragm having an excellent balance between Young's modulus and internal loss, and to a speaker.

2. Description of the Related Art

There is proposed a speaker diaphragm including a substrate and a polyethylene naphthalate fiber sheet impregnated with a resin for obtaining a very natural sound quality (see JP 2005-80098 A, for example). However, this speaker diaphragm has a problem in that the speaker diaphragm has no characteristics required for a speaker diaphragm such as high Young's modulus and moderate internal loss.

SUMMARY OF THE INVENTION

The present invention has been made in view of solving the conventional problems described above, and a primary object of the present invention is therefore to provide a speaker diaphragm having an excellent balance between Young's modulus and internal loss.

According to one aspect of the invention, a speaker diaphragm is provided. The speaker diaphragm includes a substrate and a surface material. The surface material is arranged on one side of the substrate, and includes a woven fabric of a polyethylene naphthalate fiber.

In one embodiment of the invention, the woven fabric of a polyethylene naphthalate fiber has an exposure degree of substantially 100% on an emission side.

In another embodiment of the invention, the polyethylene naphthalate fiber is substantially free from a resin.

In still another embodiment of the invention, the woven fabric of a polyethylene naphthalate fiber is a twill weave fabric.

Instill another embodiment of the invention, the polyethylene naphthalate fiber has a weave density of 150 to 400 $g/m^2$.

In still another embodiment of the invention, the polyethylene naphthalate fiber is an untwisted fiber.

In still another embodiment of the invention, the substrate includes a base material, and a thermosetting resin impregnated and cured on the base material.

Instill another embodiment of the invention, the base material includes a laminate of at least one of a woven fabric and a non-woven fabric.

In still another embodiment of the invention, the thermosetting resin includes an unsaturated polyester resin.

In still another embodiment of the invention, the substrate and the surface material are laminated through a thermoplastic resin-based adhesive layer.

In still another embodiment of the invention, the thermoplastic resin-based adhesive layer is one of a film and a non-woven fabric.

According to another aspect of the invention, a speaker is provided. The speaker includes the speaker diaphragm.

According to the present invention, the surface material including a woven fabric of a polyethylene naphthalate fiber is provided, to thereby remarkably improve the internal loss. As a result, a speaker diaphragm having an excellent balance between Young's modulus and internal loss can be obtained. Further, such a surface material is provided, to thereby provide a diaphragm having excellent response and quick vibration damping.

DESCRIPTION OF THE PREFERRED EMBODIMENTS

Figure 1:
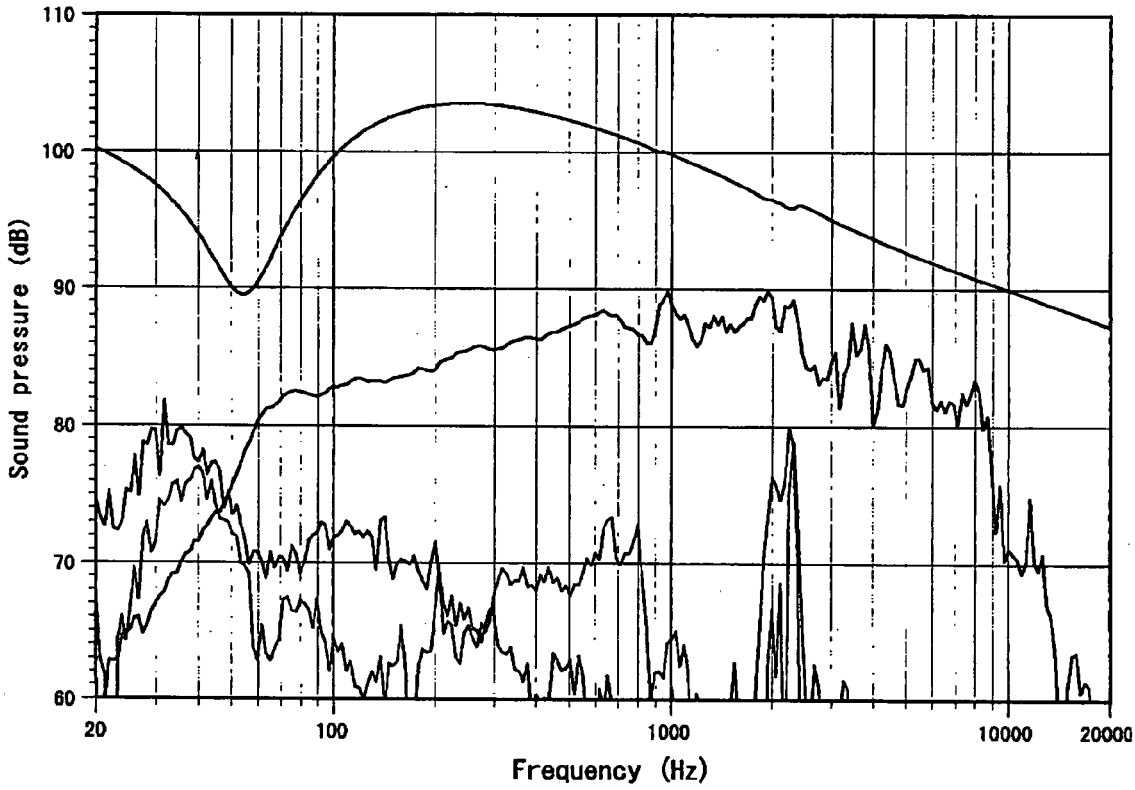
FIG. 1 is a graph showing frequency characteristics of a speaker employing a speaker diaphragm according to Example 1 of the present invention.

A speaker diaphragm of the present invention includes a substrate and a surface material, which is arranged on one side of the substrate, and includes a woven fabric of a polyethylene naphthalate (PEN) fiber.

A. Substrate

The substrate may have any appropriate structure. Preferably, the substrate includes a base material and a thermosetting resin which is impregnated and cured on the base material.

The thermosetting resin may employ any appropriate thermosetting resin. Preferred examples of the thermosetting resin include an unsaturated polyester resin, a phenol resin, and an epoxy resin, and a particularly preferred example thereof is an unsaturated polyester resin. The unsaturated polyester resin has a high curing speed and a low curing temperature, and thus a speaker diaphragm having excellent internal loss can be produced easily.

The base material preferably includes any appropriate woven fabric and/or non-woven fabric. The base material may be formed of a monolayer of the woven fabric and/or non-woven fabric, or a laminate of the woven fabric and/or non-woven fabric. Preferably, the base material is a laminate because the laminate is capable of preventing generation of sound inherently generated with a single material so as to provide a speaker diaphragm having no dips in a frequency-sound pressure curve. Typical examples of such a layer include a cotton woven fabric and a liquid crystal polymer non-woven fabric. Typical examples of the liquid crystal polymer include a wholly aromatic polyester and a wholly aromatic polyamide. Examples of the wholly aromatic polyester include: XYDAR (trade name, available from Nippon Oil Corporation); and VECTRAN (trade name, available from Kuraray Co., Ltd.). Examples of the wholly aromatic polyamide include: KEVLAR (trade name, available from Du Pont-Toray Co., Ltd.); and TECHNORA (trade name available from Teijin Ltd.). The weave density and weave structure of a woven fabric, the method of forming a non-woven fabric, and the like may appropriately be selected in accordance with the purpose. The base material may typically have a bilayer structure of liquid crystal polymer non-woven fabric/cotton woven fabric, or a three-layer structure of liquid crystal polymer non-woven fabric/PEN woven fabric/liquid crystal polymer non-woven fabric. The base material may obviously be a laminate including four or more layers.

A fiber/resin ratio of the substrate is preferably within a range of 20/80 to 80/20, and more preferably within a range of 50/50 to 70/30. A substrate having such a fiber/resin ratio is used, to thereby provide a speaker diaphragm having excellent internal loss without reducing Young's modulus. Further, generation of sound inherent to a resin can be prevented. The term "fiber/resin ratio" refers to a ratio between a weight of a base material before impregnation and a weight of an impregnating resin.

B. Surface Material

The surface material includes a woven fabric of a polyethylene naphthalate (PEN) fiber. The woven fabric of a PEN fiber may have any appropriate weave structure (such as plain weave, twill weave, satin weave, or a combination thereof). The woven fabric preferably has a twill weave structure because of excellent strength and elongation and a large weave density. As a result, a speaker diaphragm having an excellent balance between Young's modulus and internal loss can be obtained. Further, a twill weave woven fabric has a glossy texture, and thus a speaker diaphragm having an excellent appearance can be obtained. A twill weave woven fabric has a weave density (mass per unit area) of preferably 150 to 400 g/m$^2$, and more preferably 280 to 350 g/m$^2$. In the case where the weave density is less than 150 g/m$^2$, fibers may be abraded due to vibration, and thus unwanted sound may be generated. For example, a woven fabric having a fiber thickness of 1,100 dtex and a density of 32 warp threads/inch and 32 weft threads/inch may satisfy the preferred ranges described above.

The PEN fiber forming the woven fabric is preferably a fiber which is not twisted (untwisted fiber). The untwisted fiber may be used to significantly reduce a thickness per unit area, to thereby provide a lightweight diaphragm having highly excellent strength. For example, a general thermoplastic resin fiber is twisted and a thickness of a woven fabric thereof is about 1 mm with a mass per unit area of 170 g/m$^2$. Meanwhile, a plain weave woven fabric of an untwisted PEN fiber has a thickness of about 0.18 mm with the same mass per unit area, which is less than ⅕ of the thickness of the woven fabric of a twisted fiber.

The PEN fiber may employ any fiber having any appropriate thickness in accordance with the purpose, but the fiber thickness is preferably 800 to 1,400 dtex. A fiber thickness of less than 800 dtex of ten reduces the mass per unit area and provides insufficient strength. A fiber thickness of more than 1,400 dtex increases the weight and thus often reduces a sound pressure.

The surface material preferably includes substantially no resin, to thereby provide a speaker diaphragm having an excellent balance between Young's modulus and internal loss. The phrase "includes substantially no resin" indicates that the woven fabric of the PEN fiber is not impregnated with a resin. That is, an exposure degree of the woven fabric of a PEN fiber is substantially 100% on an emission side.

The speaker diaphragm of the present invention can typically be obtained by laminating the substrate and the surface material through an adhesive layer. The adhesive layer is preferably formed of a thermoplastic resin-based adhesive for its excellent productivity. Specifically, a laminate obtained by laminating the substrate, the thermoplastic resin-based adhesive, and the surface layer in the order given is arranged in a mold, and the whole is subjected to heat forming, to thereby obtain a speaker diaphragm.

The thermoplastic resin-based adhesive may employ any appropriate resin. Specific examples of the resin include: a urethane-based resin; an amide-based resin such as nylon; an ester-based resin such as polybutylene terephthalate (PBT); and an acrylic resin. A melting point of the thermoplastic resin-based adhesive is preferably 80 to 150° C. Examples of a form of the thermoplastic resin-based adhesive include powder, a film, and a non-woven fabric. Preferred examples thereof include a film and a non-woven fabric because of excellent productivity. In the case where the thermoplastic resin-based adhesive is in a form of a non-woven fabric, its mass per unit area is preferably 20 to 100 g/m$^2$.

According to another aspect of the present invention, a speaker is provided. The speaker includes the speaker diaphragm described above and formed into a predetermined shape.

Hereinafter, the present invention will be described more specifically by using examples, but the present invention is not limited to the examples. Parts and percents in the examples refer to parts by weight and wt % unless otherwise noted.

EXAMPLE 1

(Preparation of Unsaturated Polyester Resin Composition)

A thermosetting resin composition having the following composition was prepared.

Unsaturated polyester resin (N350L, available from Japan Composite Co., LTD.): 100 parts Low profile additive (MODIPER S501, available from NOF Corporation): 5 parts Curing agent (PEROCTA O, available from NOF Corporation): 1.3 parts (Preparation of Base Material)

An aramid fiber non-woven fabric (TECHNORA, available from Teijin Ltd., mass per unit area of 60 g/m$^2$), a cotton woven fabric (cotton count of 20, density of 40 warp threads and 40 weft threads, mass per unit area of 110 g/m$^2$), and an aramid fiber non-woven fabric (TECHNORA, available from Teijin Ltd., mass per unit area of 60 g/m$^2$) were laminated in the order given, and the laminate was cut into a size of about 18 cm×18 cm, to thereby obtain a base material.

(Preparation of Substrate)

Two jigs each having a circular hole with a diameter of about 16 cm in a center part of a stainless steel plate of about 18 cm×18 cm were prepared, and the above-mentioned base material was inserted between the two jigs. The above-mentioned unsaturated polyester composition (about 5 g) was dropped to a vicinity of a center of the clamped base material. Then, the whole was formed at 130° C. and a pressure of 10 to 20 MPa for 30 seconds by using a matched-die having a predetermined shape. The die was cooled and opened, to thereby obtain a substrate having a diameter of 16 cm and a thickness of 0.40 mm.

(Formation of Speaker Diaphragm)

The substrate was set in a mold, and to an upper surface of the substrate, a hot melt-type adhesive film (THERMOLITE 2810, available from Daicel Finechem Ltd.) and a woven fabric of a polyethylene naphthalate (PEN) fiber (available from Teijin Shoji Co., Ltd., twill weave, fiber thickness of 1,100×1,100 dtex, density of 34 warp threads/inch and 34 weft threads/inch, mass per unit area of 322 g/m$^2$) were laminated in the stated order. The laminate was clamped to a jig and pressurized at 130° C. and a pressure of 1 to 3 MPa for 10 seconds, to thereby obtain a diaphragm having a diameter of 16 cm and a thickness of 0.6 mm.

EXAMPLE 2

A speaker diaphragm having a diameter of 16 cm and a thickness of 0.5 mm was obtained in the same manner as in Example 1 except that a base material was produced by laminating an aramid fiber non-woven fabric (TECHNORA, available from Teijin Co., Ltd., mass per unit area of 60 g/m$^2$) and a cotton woven fabric (cotton count of 20, density of 40 warp threads and 40 weft threads, mass per unit area of 110 g/m$^2$). Note that the substrate had a diameter of 16 cm and a thickness of 0.30 mm.

EXAMPLE 3

A speaker diaphragm having a diameter of 16 cm and a thickness of 0.53 mm was obtained in the same manner as in Example 1 except that a woven fabric of a polyethylene naphthalate (PEN) fiber (available from Teijin Shoji Co., Ltd., plain weave, fiber thickness of 1,100×1,100 dtex, density of 17 threads/inch and 17 threads/inch, mass per unit area of 163 g/m$^2$) was used instead of the woven fabric of a polyethylene naphthalate (PEN) fiber (available from Teijin Shoji Co., Ltd., twill weave, fiber thickness of 1,100×1,100 dtex, density of 34 threads/inch and 34 threads/inch, mass per unit area of 322 g/m$^2$)

Comparative Example 1

A phenol resin composition (5900, trade name, available from Dainippon Ink and Chemicals, Inc.) as a thermosetting resin was impregnated and cured on a woven fabric of a polyethylene naphthalate (PEN) fiber (available from Teijin Shoji Co., Ltd., plain weave, fiber thickness of 1,100×1,100 dtex, density of 17 threads/inch and 17 threads/inch, mass per unit area of 163 g/m$^2$), to thereby obtain a fabric having a mass per unit area of 190 g/m$^2$.

A speaker diaphragm having a diameter of 16 cm and a thickness of 0.40 mm was obtained in the same manner as in Example 2 except that the fabric described above was used instead of the woven fabric of a polyethylene naphthalate (PEN) fiber (available from Teijin Shoji Co., Ltd., twill weave, fiber thickness of 1,100×1,100 dtex, density of 34 threads/inch and 34 threads/inch, mass per unit area of 322 g/m$^2$)

The density, Young's modulus (E), and internal loss (tan δ) of each of the obtained speaker diaphragms were measured by a conventional method. Further, specific modulus (E/density) and rigidity (E×(thickness)$^3$) were calculated from results of the measurement. Table 1 collectively shows the obtained results.

TABLE 1

| | Young's modulus E (Pa) | Density (g/cm$^3$) | tan δ | Thickness (mm) | Specific modulus (E/Density) | Rigidity (E * Thickness$^3$) |
|---|---|---|---|---|---|---|
| Example 1 | $4.32 \times 10^9$ | 1.21 | 0.20 | 0.60 | $3.57 \times 10^9$ | $0.54 \times 10^9$ |
| Example 2 | $3.20 \times 10^9$ | 1.20 | 0.25 | 0.50 | $2.66 \times 10^9$ | $0.40 \times 10^9$ |
| Example 3 | $3.11 \times 10^9$ | 1.23 | 0.18 | 0.53 | $2.52 \times 10^9$ | $0.46 \times 10^9$ |
| Comparative Example 1 | $3.25 \times 10^9$ | 1.45 | 0.02 | 0.40 | $2.24 \times 10^9$ | $0.21 \times 10^9$ |

Table 1 clearly shows that the diaphragm of each of Examples had an excellent internal loss and an excellent balance between Young's modulus and internal loss compared with those of the speaker diaphragm of Comparative Example 1. In particular, the diaphragm of Example 1 had excellent Young's modulus, density, and internal loss compared with those of the diaphragm of Comparative Example 1. The results of Examples 1 to 3 clearly show that a speaker diaphragm having a more excellent balance between Young's modulus and internal loss can be obtained by using a woven fabric of a PEN fiber with a twill weave fabric.

Figure 2:
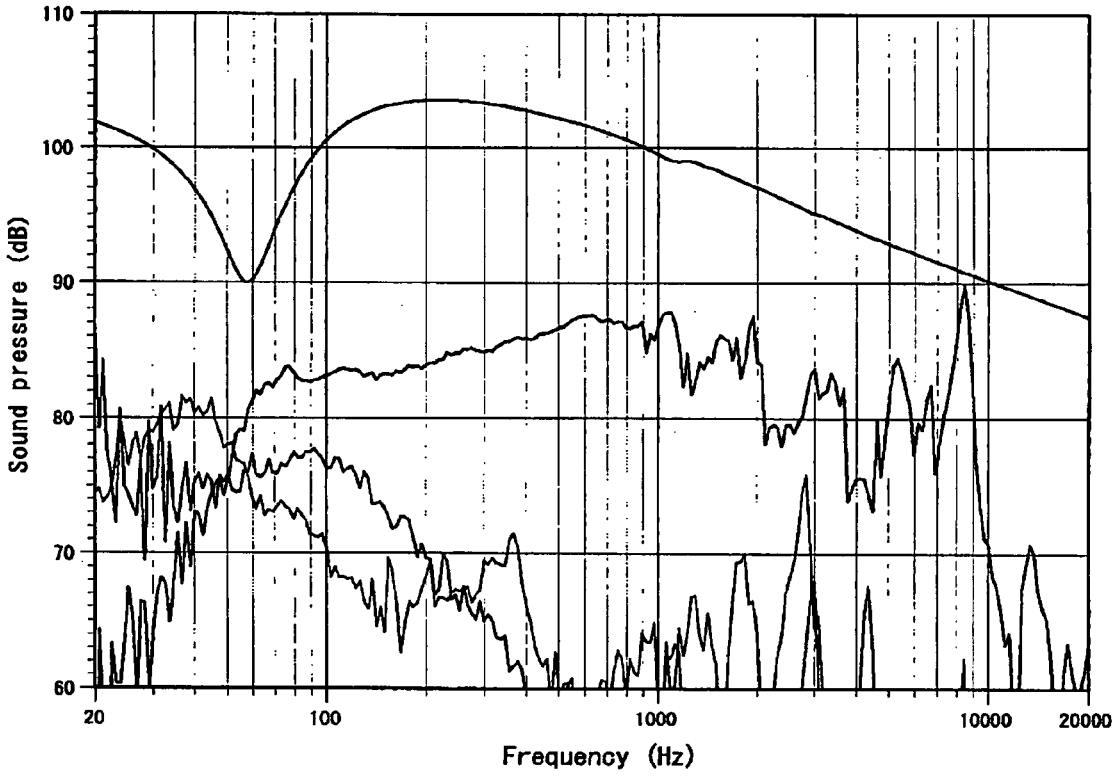
FIG. 2 is a graph showing frequency characteristics of a speaker employing a speaker diaphragm according to Comparative Example 1.

Frequency characteristics of the speaker employing the speaker diaphragm of each of Example 1 and Comparative Example 1 were measured. FIG. 1 shows the results of Example 1, and FIG. 2 shows the results of Comparative Example 1. The speaker diaphragm of Example 1 had few dips in the frequency-sound pressure curve due to an excellent balance between Young's modulus and internal loss. In contrast, the speaker diaphragm of Comparative Example 1 had distinct peaks in a high frequency region (above 1000 Hz) of the frequency-sound pressure curve because of a small internal loss.

The speaker diaphragm of the present invention has an excellent balance between Young's modulus and internal loss, and may preferably used for a speaker in any applications (that is, regardless of a large or small diameter speaker).

Many other modifications will be apparent to and be readily practiced by those skilled in the art without departing from the scope and spirit of the invention. It should therefore be understood that the scope of the appended claims is not intended to be limited by the details of the description but should rather be broadly construed.

What is claimed is:

1. A speaker diaphragm comprising a substrate and a surface material, which is arranged on only one side of the substrate, and includes a woven fabric of a polyethylene naphthalate fiber, wherein the woven fabric of a polyethylene naphthalate fiber has an exposure degree of substantially 100% on an emission side, and wherein the substrate and the surface material are laminated through an adhesive layer.

2. A speaker diaphragm according to claim 1, wherein the polyethylene naphthalate fiber is substantially free from a resin.

3. A speaker diaphragm according to claim 1, wherein the woven fabric of a polyethylene naphthalate fiber is a twill weave fabric.

4. A speaker diaphragm according to claim 3, wherein the polyethylene naphthalate fiber has a weave density of 150 to 400 g/m$^2$.

5. A speaker diaphragm according to claim 1, wherein the polyethylene naphthalate fiber is an untwisted fiber.

6. A speaker diaphragm according to claim 1, wherein the substrate comprises a base material, and a thermosetting resin impregnated and cured on the base material.

7. A speaker diaphragm according to claim 6, wherein the base material comprises a laminate of at least one of a woven fabric and a non-woven fabric.

8. A speaker diaphragm according to claim 6, wherein the thermosetting resin comprises an unsaturated polyester resin.

9. A speaker diaphragm according to claim 1, wherein the substrate and the surface material are laminated through a thermoplastic resin-based adhesive layer.

10. A speaker diaphragm according to claim 9, wherein the thermoplastic resin-based adhesive layer is one of a film and a non-woven fabric.

11. A speaker, comprising a speaker diaphragm including a substrate and a surface material, which is arranged on only one side of the substrate, and includes a woven fabric of a polyethylene naphthalate fiber, wherein the woven fabric of a polyethylene naphthalate fiber has an exposure degree of substantially 100% on an emission side, and wherein the substrate and the surface material are laminated through an adhesive layer.

* * * * *